US011178903B2

(12) United States Patent
Gindrat et al.

(10) Patent No.: US 11,178,903 B2
(45) Date of Patent: Nov. 23, 2021

(54) METHOD FOR ADJUSTING THE DIAMETER OF AN ELONGATED ROD

(71) Applicant: PHILIP MORRIS PRODUCTS S.A., Neuchatel (CH)

(72) Inventors: Pierre-Yves Gindrat, Saxon (CH); Zsolt Albert, Boudry (CH)

(73) Assignee: Philip Morris Products S.A., Neuchatel (CH)

( * ) Notice: Subject to any disclaimer, the term of this patent is extended or adjusted under 35 U.S.C. 154(b) by 752 days.

(21) Appl. No.: 15/766,422

(22) PCT Filed: Oct. 7, 2016

(86) PCT No.: PCT/EP2016/074089
§ 371 (c)(1),
(2) Date: Apr. 6, 2018

(87) PCT Pub. No.: WO2017/060484
PCT Pub. Date: Apr. 13, 2017

(65) Prior Publication Data

US 2018/0310611 A1 Nov. 1, 2018

(30) Foreign Application Priority Data

Oct. 8, 2015 (EP) ..... 15188950

(51) Int. Cl.
*A24C 5/34* (2006.01)
*A24D 3/02* (2006.01)
(Continued)

(52) U.S. Cl.
CPC ..... *A24C 5/34* (2013.01); *A24C 5/01* (2020.01); *A24C 5/1807* (2013.01); *A24C 5/322* (2013.01);
(Continued)

(58) Field of Classification Search
None
See application file for complete search history.

(56) References Cited

U.S. PATENT DOCUMENTS 432,236 A 7/1890 Hadfield
2,164,423 A * 7/1939 Podmore ..... A24C 5/1807 131/66.2

(Continued)

FOREIGN PATENT DOCUMENTS

DE 2826219 11/1979
EP 2057908 5/2009

OTHER PUBLICATIONS

PCT Search Report and Written Opinion for PCT/EP2016/074089 dated Jan. 4, 2017 (10 pages).

*Primary Examiner* — Michael H. Wilson
*Assistant Examiner* — Dionne W. Mayes
(74) *Attorney, Agent, or Firm* — Mueting Raasch Group

(57) ABSTRACT

The invention relates to a method for adjusting the diameter of an elongated rod, said method comprising: providing an elongated rod having a preliminary diameter; selecting a desired final diameter of the elongated rod; providing a diameter adjusting device including a first tubular element having an inlet and an outlet and a channel connecting the inlet and the outlet; adjusting the diameter of the outlet as a function of the desired final diameter of the elongated rod, wherein the diameter of the inlet is bigger than the diameter of the outlet when adjusted; and inserting the elongated rod in the diameter adjusting device from the inlet and outputting it from the outlet so that said elongated rod is compressed to the desired final diameter when outputted from the outlet of the first tubular element.

16 Claims, 2 Drawing Sheets

(51) Int. Cl.

| | |
|---|---|
| ***A24C 5/01*** | (2020.01) |
| ***A24C 5/18*** | (2006.01) |
| ***A24C 5/32*** | (2006.01) |

(52) U.S. Cl.
CPC ..... *A24D 3/0229* (2013.01); *A24D 3/0233* (2013.01); *A24D 3/0295* (2013.01)

(56) References Cited

U.S. PATENT DOCUMENTS

| | | | |
|---|---|---|---|
| 3,645,175 | A | 2/1972 | Rakowicz |
| 3,782,154 | A | 1/1974 | Fuchs |
| 4,688,583 | A | 8/1987 | Neri |

* cited by examiner

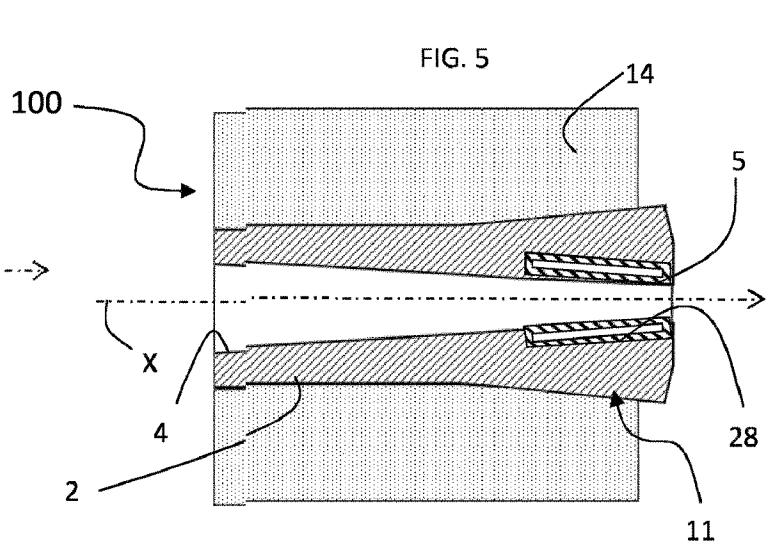
FIG. 5
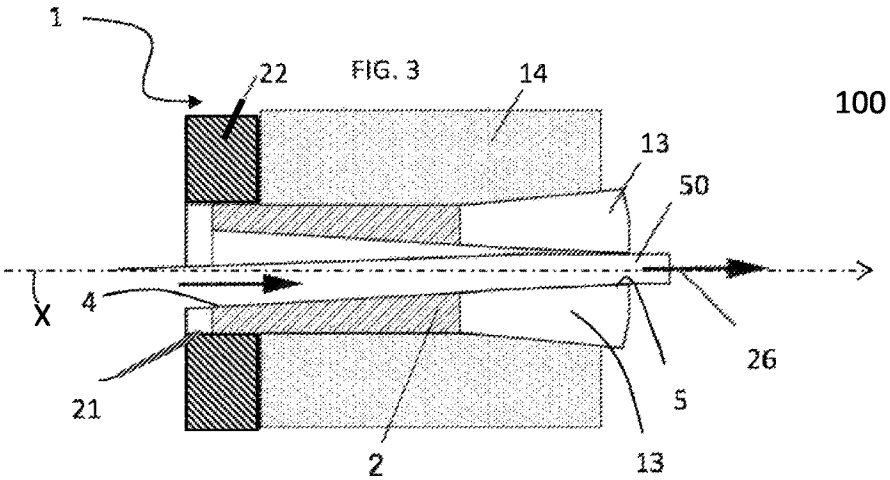
FIG. 3
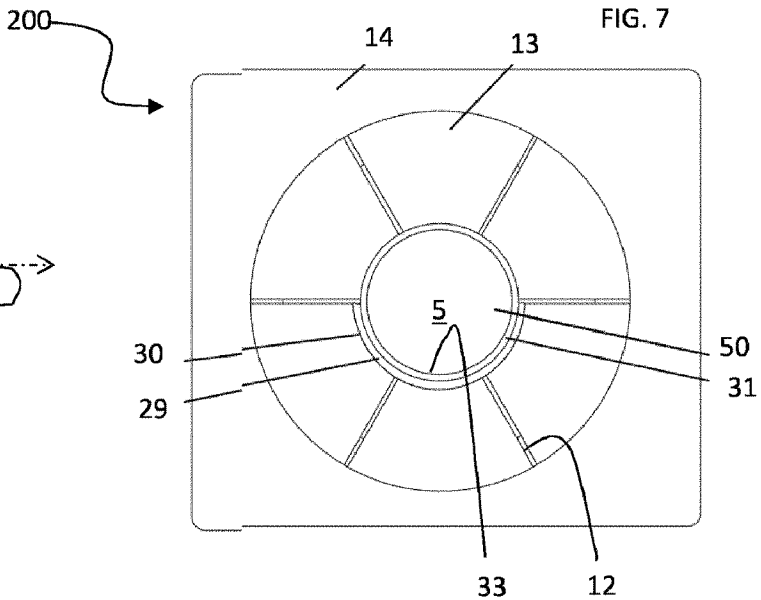
FIG. 7
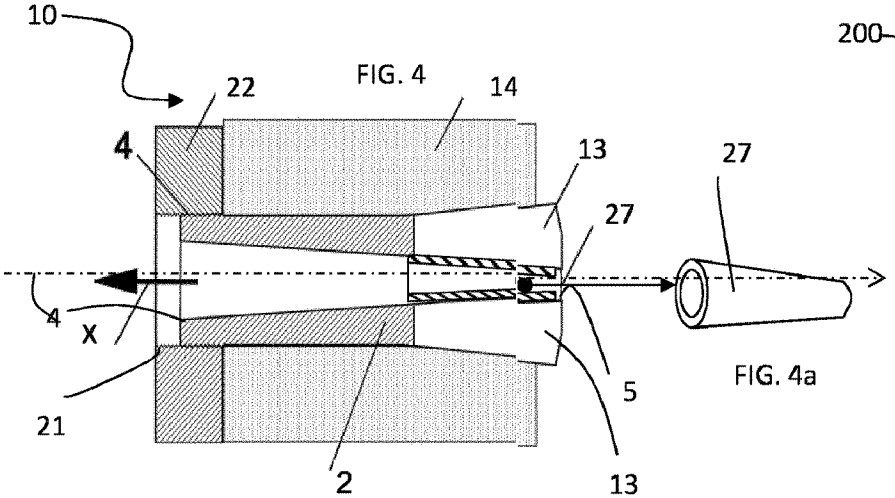
FIG. 4
FIG. 4a

METHOD FOR ADJUSTING THE DIAMETER OF AN ELONGATED ROD

This application is a U.S. National Stage Application of International Application No. PCT/EP2016/074089, filed Oct. 7, 2016, which was published in English on Apr. 13, 2017, as International Publication No. WO 2017/060484 A1. International Application No. PCT/EP2016/074089 claims priority to European Application No. 15188950.8 filed Oct. 8, 2015.

The present invention relates to a method for adjusting the diameter of an elongated rod, for example within a method for manufacturing an aerosol forming article having a desired firmness.

In the manufacturing of tobacco stick, cigarette paper is generally put on a continuously high speed running conveyor belt, then different components of the tobacco stick are added on the paper, and then the paper and tobacco stick components pass into a U shaped conveyor belt. The paper side is then glued and the paper closed around the tobacco stick.

Afterwards, and preferably before the glue gets dry, a specific "pressing tool", having a cylindrical contact surface, is pressed on top of the paper so that the combination of the U shaped conveyor belt and pressing tool cylindrical surface give to the paper and to the tobacco stick components wrapped inside a roughly cylindrical shape with a specific diameter, as commonly desired in a smoking article.

The tobacco stick hardness (also known as "firmness") is generally considered by the user as a quality aspect of the tobacco stick. However, the various qualities of the different components of the tobacco stick, including resistance to compression, could unexpectedly slightly change along the time, which implies to be able to adapt the diameter of the rod and paper during the manufacturing process above described to keep the wished cigarette hardness.

Due to production schedule constraint, it is desired that such adjustment takes place without stopping the production line, in order to avoid machine interruption.

In the known manufacturing method, this adjustment is achieved adjusting the pressing force exerted by the pressing tool on top of the paper and of the tobacco stick components in real time while the production is running.

However, because the diameter of the U shaped conveyor belt as well as the diameter of the pressing tool contact surface are fixed, and that the pressing tool is more or less pressed on the paper and tobacco stick components, the circle defined by the arc of circle of the pressing tool contact surface and the circle defined by the arc of circle of the U shaped conveyor belt could sometimes not have exactly the same center, resulting in a tobacco stick product not having a perfect cylinder shape.

Furthermore, because the belt supporting the paper and the tobacco stick components is running at high speed and that the pressing tool is static, a junction gap is formed between the U shaped belt and the pressing tool, thus engraving marks may result under some conditions on the outside surface of the paper, along the junction gaps.

Both the asymmetrical cylindrical shape of the tobacco stick and the visible pressing marks on the paper are not satisfactory and are considered as problems to be solved.

There is therefore a need for a method of adjusting the diameter of an elongated rod, such as those used in manufacturing an aerosol forming article in which the desired firmness of the aerosol forming article is achieved. Further, there is a need for a method in which, when the manufacturing conditions change, the firmness is maintained constant without production interruptions and at the same time is also maintained the desired quality of a correct cylindrical shape and smooth surface of the end aerosol forming article.

The purpose of the invention may be to at least partially fulfill one or more of the above mentioned needs.

In particular, the invention relates to a method for adjusting the diameter of an elongated rod, said method comprising: providing the elongated rod having a preliminary diameter; selecting a desired final diameter of the elongated rod; providing a diameter adjusting device including a first tubular element having an inlet and an outlet and a channel connecting the inlet and the outlet; adjusting the diameter of the outlet as a function of the desired final diameter of the elongated rod, wherein the diameter of the inlet is bigger than the diameter of the outlet when adjusted; inserting the elongated rod in the diameter adjusting device from the inlet and outputting it from the outlet so that said elongated rod is compressed to the desired final diameter when outputted from the outlet of the first tubular element.

Further, the invention relates to a method for manufacturing an aerosol forming article, said method comprising: providing an elongated rod having a preliminary diameter; selecting a desired final diameter of the elongated rod; providing a diameter adjusting device including a first tubular element having an inlet and an outlet and a channel connecting the inlet and the outlet; adjusting the diameter of the outlet as a function of the desired final diameter of the elongated rod, wherein the diameter of the inlet is bigger than the diameter of the outlet when adjusted; inserting the elongated rod in the diameter adjusting device from the inlet and outputting it from the outlet so that said elongated rod is compressed to the desired final diameter when outputted from the outlet of the first tubular element.

The method of the present invention may allow controlling the diameter of an elongated rod, which can be part of an aerosol forming article. The diameter of the elongated rod, prior to the application of the method of the invention, is larger than the final diameter of the elongated rod after the application of the method of the invention. The final diameter may be tuned very accurately by the method of the invention and may be easily changed and adapted to the different manufacturing conditions and requirement in order to obtain the desired rod firmness. Further, the shape of the rod, that is, its cross-section, may have a rather accurate and non-distorted substantially circular shape.

Aerosol-forming articles typically comprise a cylindrical rod including tobacco surrounded by a paper, called wrapper. Further, the aerosol forming articles may further comprise a cylindrical filter axially aligned in an abutting end-to-end relationship with the wrapped tobacco rod.

Aerosol forming articles according to the present invention may be in the form of filter cigarettes or other smoking articles in which tobacco material is combusted to form smoke. The present invention additionally encompasses articles in which tobacco material is heated to form an aerosol, rather than combusted, and articles in which a nicotine-containing aerosol is generated from a tobacco material, tobacco extract, or other nicotine source, without combustion or heating. These articles in which aerosol is formed without combustion or where smoke is produced by combustion are in general called "aerosol-forming articles". Aerosol forming articles according to the invention may be whole, assembled aerosol forming articles or components of aerosol forming articles that are combined with one or more other components in order to provide an assembled article for producing an aerosol, such as for example, the consumable part of a heated smoking device.

As used herein, aerosol forming article is any article that generates an inhalable aerosol when an aerosol forming substrate is heated. The term includes articles that comprise an aerosol forming substrate that is heated by and external heat source, such as an electric heating element. An aerosol forming article may be a non-combustible aerosol forming article, which is an article that releases volatile compounds without the combustion of the aerosol-forming substrate. An aerosol forming article may be a heated aerosol forming article, which is an aerosol forming article comprising an aerosol forming substrate that is intended to be heated rather than combusted in order to release volatile compounds that can form an aerosol. The term includes articles that comprise an aerosol forming substrate and an integral heat source, for example a combustible heat source.

An aerosol forming article may be an article that generates an aerosol that is directly inhalable into a user's lungs through the user's mouth. An aerosol forming article may resemble a conventional smoking article, such as a cigarette and may comprise tobacco. An aerosol forming article may be disposable. An aerosol forming article may alternatively be partially-reusable and comprise a replenisheable or replaceable aerosol forming substrate.

An aerosol forming article may also include a combustible cigarette.

The elongated rod subjected to the method of the invention can be a tobacco rod including a cut filler and thus adapted for combustion taking place in combustible aerosol generating articles, or a tobacco rod including reconstituted tobacco or homogenised tobacco, preferably a sheet of reconstituted tobacco or homogenised tobacco comprising a proportion of an aerosol-former, such as glycerine.

In both cases, the elongated rod may include, in addition to tobacco, any of the following, singularly or in combination: additives, binders and flavorant.

As used herein, the term "rod" is used to denote a generally cylindrical element of substantially circular cross-section. The rod defines a longitudinal main axis. With the term "rod" also a continuous strip of material is meant, having a "rod-like" continuous shape.

Preferably, rods as described herein are of substantially uniform cross-section.

Rods as described herein may be produced having different preliminary diameters depending upon their intended use. There is no limitation on the initial or preliminary diameter of the elongated rod. Further, the elongated rod having the preliminary diameter may be realized according to any known method in the art, for example using a cigarette maker machine.

For example, rods as described herein may have a preliminary diameter of between about 5 millimeters and about 10 millimeters, more preferably between about 5 millimeters and about 8 millimeters, depending upon their intended use.

As used herein, by "diameter" is meant the maximum transverse dimension of the elongated rod.

Preferably, but not necessarily, the elongated rod is surrounded by paper. The cigarette paper may be prepared using any known papermaking technique known in the art. The resulting cigarette wrapper may have a neutral taste or it can be specifically flavored.

The final diameter of the elongated rod is selected depending on the desired firmness to be obtained and it depends among others on the preliminary diameter of the elongated rod and on the material in which the elongated rod is formed. In the method of the invention, a first final diameter of the elongated rod is selected. However, the final diameter of the elongated rod may also have to be selected again, that is, it may need to be changed during production, due to the fact that the components or material forming the elongated rod, such as for example the cut filler or the homogenized tobacco material, do not constantly maintain their characteristics uniformly, but their density or moisture or others may vary. Therefore, the final diameter of the elongated rod may be changed and selected several times during production.

Preferably, also the final diameter of the elongated rod is comprised between about 5 millimeters and about 10 millimeters, more preferably between about 5 millimeters and about 8 millimeters. Preferably, if the rod is wrapped in wrapping paper, its preferred final diameter is comprised between about 7 millimeters and about 8 millimeters. The elongated rod having its preliminary diameter is handled by a diameter adjusting device in order to reduce its preliminary diameter to the set final diameter. The diameter adjusting device includes a first tubular element having an inlet where the elongated rod is inserted, and an outlet from which the rod exits the device.

The diameter of the inlet is large enough to accommodate the rod. However, it is not necessary that the inlet defines a circular aperture. In case the inlet defines an aperture shape different from circular, with the term "diameter" the maximum dimension of the aperture is meant. In case the aperture is circular, then the diameter of the inlet is bigger than the preliminary diameter of the rod, so that the rod can be inserted without damage in the diameter adjusting device.

The outlet of the diameter adjusting device defines a substantially circular aperture. It has to be understood that the "circular" includes all shapes which are to be considered circular within the standard accepted tolerances in construction of tools in this technical field. The dimension of the circular aperture defined by the outlet, and in particular its diameter, is set according to the value of the selected final diameter desired for the elongated rod, therefore advantageously it is a function of the final diameter which has been selected for the elongated rod on the basis of the desired firmness of the resulting rod in the above step of the method of the invention. Preferably, the diameter of the outlet is preferably equal to or slightly bigger than the selected final diameter set for the elongated rod. The diameter of the outlet can be adjusted so that it can be adapted during production or in case of a different batch needs to be produced, for example in case a different aerosol forming article having a different diameter has to be fabricated.

The inlet and the outlet of the first tubular element are connected by means of a channel in which the elongated rod may be inserted. The first tubular element preferably includes an inner surface and an outer surface and it further defines a longitudinal axis running from the inlet to the outlet. Preferably, such inner surface is smooth, more preferably also the outer surface is smooth, without sharp corners or protrusions. Preferably, the outer surface of the first tubular element is tapered at least for a portion with a decreasing diameter from the outlet towards the inlet. A section of the outer surface of the first tubular element in a plane substantially perpendicular to the longitudinal axis advantageously defines a substantially circular shape the boundary of which is given by the outer surface. The shape defined by the section has preferably a diameter which changes and, more preferably, moving the section plane from the outlet to the inlet, it decreases, at least for a portion of the first tubular element.

Furthermore, the inner surface has preferably substantially a constant diameter when outside the adjusting phase, for example in an uncompressed state. The diameter of the inner surface can be changed at the outlet in order to set the outlet diameter. However, preferably, outside the adjusting phase, such as in the uncompressed state, the diameter of the inlet is equal to the diameter of the outlet. However, when an adjustment takes place, for example a compression take place, also the inner surface includes a tapered portion. In this tapered portion, the inner surface decreases its diameter along the longitudinal axis moving towards the outlet. In the adjusting phase, therefore, the diameter of the channel reduces moving from the inlet toward the outlet. In this way, the change in diameter inside the first tubular element is not abrupt but substantially continuous without steps, protrusions or indents which may deform or leave marks on an outer surface of the elongated rod.

The step of adjusting the diameter of the outlet preferably comprises to compress the first tubular element at its outlet.

During production, according to the method of the invention, the elongated rod is inserted in the first tubular element via its inlet, where it can easily enter due to the diameter difference between the rod and the inlet. The elongated rod is then pushed towards the outlet of the diameter adjusting device. In its progression towards the outlet, the elongated rod begins experiencing a compression due to the fact that, from a given point along the longitudinal axis of the first tubular element, the diameter of the inner surface of the first tubular element becomes smaller than or equal to the preliminary diameter of the elongated rod.

Due to the type of material in which the rod is realized, the size, that is the diameter, of the elongated rod can be changed by compression, because the elongated rod material can be compressed at least partially. Therefore, the compression exerted by the inner surface of the first tubular element onto the outer surface of the elongate rod packs the material in which the rod is realized, increasing the resistance and "firmness" of the rod and at the same time changing its diameter.

The final diameter of the elongated rod is determined by the compression exerted by the first tubular element inner surface and by the set size of the outlet of the diameter adjustment tool. The diameter of the elongated rod may be in this way easily changed and no marks may be left on the outer surface of the elongated rod. Further, changes of the final diameter during production may be possible easily and without resulting in a final product having a lower quality, due to the changes that can be made in the outlet diameter of the first tubular element.

Advantageously, the method includes the steps of measuring the diameter of the elongated rod at the outlet of the first tubular element; and adjusting the diameter of the outlet of the first tubular element on the basis of the diameter measurement. In order to provide a feedback, preferably after the elongated rod has exited the first tubular element, the final diameter of the tubular element is checked. If the measured final diameter does not satisfy the required specifications, that is, in case the measured final diameter is different than a preferred set final diameter by more than a given threshold, the diameter of the outlet is changed. For example, if the measured final diameter is "too large", the diameter of the outlet may be decreased. If the measured final diameter is "too small", the diameter of the outlet may be increased accordingly.

Preferably, the first tubular element includes an elastic portion, the elastic portion including the outlet, and the step of adjusting the diameter of the outlet includes compressing or decompressing the elastic portion. The adjustment of the outlet diameter of the first tubular element may be made at the beginning of the production in order to set the desired final diameter of the elongated rod to be produced. The adjustment of the outlet diameter may be made during production to change the final diameter of the elongated rod from one value to another, for example because during production the material in which the rod is realized has slightly changed its characteristics. In the latter case, keeping the value of final diameter identical to the value set at the beginning of production, without changes, would result in an elongated rod having a sub-optimal firmness. The final diameter may need to be changed during production because a new aerosol forming article is to be manufactured having a different final diameter, and therefore the diameter of the outlet of the first tubular element need to be changed as well. The first tubular element may comprise an elastic portion, which can be compressed or decompressed, the elastic portion including the outlet. A compression of the elastic portion leads to a decrease in the size of the diameter of the outlet, while a decompression leads to an increase of the size of the diameter of the outlet. Preferably, not only the diameter of the outlet is increased or decreased due to compression, but the diameter of a whole portion of the channel defined within the first tubular element. For example, the inner diameter of the whole portion of the channel belonging to the elastic portion is changed. In an easy manner, the size or dimension of the outlet may be thus tuned.

More preferably, the elastic portion includes an outer surface which is funnel-shaped or an inner surface which is funnel-shaped, or both an inner and an outer surfaces which are funnel-shaped, when the adjusting step takes place. The other surface having a funnel shape is preferably used as a compression portion in order to adjust the size of the diameter of the outlet. A funnel shape in the inner surface when in the adjustment step may provide the first tubular element with a smooth inner surface, the diameter of which is gradually changing up to the desired final diameter. Preferably, the inner surface of first tubular element, when in the adjusting step, comprises a first portion including the inlet and having a substantially constant diameter in cross-section and the elastic portion, extending from the first portion, having a changing diameter due to its funnel shape, more preferably having a decreasing diameter along a longitudinal axis of the tubular element up to the outlet. Therefore the diameter of the first tubular element may be changed from the inlet diameter dimension to the outlet diameter dimension in a smooth and continuous manner.

Advantageously, the method of the invention further comprises the steps of providing the elastic portion with slits cutting said elastic portion substantially along a longitudinal axis of the first tubular element; and compressing or decompressing the elastic portion by reducing or enlarging the slits spacing. The first tubular element may comprise substantially a chuck, more preferably a collet, apt to clamp and compress the elongated rod. Differently from the know art, in the present invention the chuck or collet is not used to hold in a specific fixed position the elongated rod, but to compress it while the elongated rod is extracted from the chuck or collet, in order to change its diameter. The slits, also called kerf cuts in the field of collets, formed in the elastic element preferably parallel to the longitudinal axis of the first tubular element, may define "jaws" in the elastic element which can contract or expand so that the outlet diameter can be varied changing the distance between the jaws. The slits start preferably from the outlet and therefore they divide the circumference of the outlet in a plurality of arcs of circumference. In order to change the size of the outlet, pressing on the outer surface of the jaws, which preferably corresponds to a portion of the outer surface of the elastic portion, brings the jaws closer and thus reduces the diameter of the outlet.

More preferably, the method of the invention further comprises covering said slits by inserting a tubular hollow cover onto said elastic portion to cover an inner surface of said elastic portion where the slits are present. Covering the slits allows minimizing the risk that the compression exerted by the jaws onto the rod when the jaws are in turn compressed may leave marks onto the outer surface of the elongated rod due to the slits' presence.

In an advantageous embodiment, the method comprises providing the diameter adjusting device with a second tubular element; partially inserting the first tubular element into the second tubular element; and adjusting the diameter of the outlet of the first tubular element by inserting the first tubular element for a longer or shorter portion into said second tubular element. When the first tubular element includes an elastic element, inserting the first tubular element inside the second tubular element compresses the elastic portion, while withdrawing the first tubular element from the second tubular element expands the elastic portion. In this way, increasing or decreasing the insertion of the first tubular element in the second tubular element may allow to control the amount of pressure on the elastic element and thus to control the size of the outlet diameter, which in turn controls the size of the final diameter of the elongated rod.

More preferably, the method includes providing the first tubular element with a tapered external surface portion including the outlet, the tapered external surface portion having the widest dimension of its tapered external surface at the outlet of the first tubular element; providing the second tubular element with a tapered internal surface portion, the tapered internal surface having a shape mating with the external surface of the tapered external surface portion of the first tubular element; and inserting the first tubular element inside the second tubular element so that the tapered external surface portion of the first tubular element is compressed due to the tapered internal surface portion of the second tubular element. The second tubular element may have the function of a first tubular element housing. The second tubular element may include a channel to host the first tubular element and it also defines an inner surface running from the inlet to the outlet of the channel and an outer surface. The inner surface of the second tubular element comprises a tapered portion, that is, the inner surface has a variable diameter. The tapered inner surface has a size which increases from the inlet toward the outlet of the second tubular element, so that the second tubular element squeezes with its internal tapered surface the external tapered surface of the first tubular element, changing the diameter size of the outlet of the first tubular element. Advantageously, the external tapered surface portion of the first tubular element corresponds to the external surface of the elastic portion of the first tubular element. The more the first tubular element is inserted into the second tubular element, the more the tapered external surface of the first tubular element is compressed by the internal tapered surface of the second tubular element. Therefore, in order to control the size of the outlet of the first tubular element, the amount of compression exerted by the tapered inner surface portion of the second tubular element onto the tapered external surface portion of the first tubular element is preferably controlled. The amount of compression is controlled controlling a length of insertion of the first tubular element inserted into the second tubular element. The amount of first tubular element which is inserted into the second tubular element along a longitudinal axis of the second tubular element is preferably controlled.

Advantageously, in order to obtain this control in the compression, the step of inserting the first tubular element into the second tubular element comprises providing the first tubular element with a threated portion at the inlet; providing a collar coupled to the threated portion; and screwing or unscrewing the collar to push the first tubular element inward or outward, respectively, the second tubular element. The act of screwing the collar onto the threads realized at the inlet of the first tubular element generates a force which is applied onto the second tubular element, which is in abutment to the collar. The length of the portion of the first tubular element inserted into the second tubular element increases and thus the dimension of the outlet of the first tubular element decreases. For example, due to this force, the internal tapered surface of the second tubular element presses against the external tapered surface of the first tubular element and the latter compresses, decreasing the size of the outlet of the first tubular element. If the first tubular element includes slits in the internal tapered surface, the slits due to screwing reduce their spacing and the outlet has a reduced diameter. On the contrary, unscrewing the collar releases the compression, because no or less force is acting to keep the first tubular element inserted into the second tubular element.

Alternatively to the presence of a collar which can be screwed or unscrewed on the first tubular element, the step of inserting the first tubular element into the second tubular element comprises providing a magnetic actuator or a hydraulic system to insert the first tubular element for a longer or shorter portion into the second tubular element. The magnetic actuator or the hydraulic system may operate to change the length of insertion of the first tubular element into the second tubular element. This allows to change the compression exerted by the second tubular element on the jaws created in the elastic portion of the first tubular element.

Preferably, the method comprises: providing the elastic portion with an inflatable element; and compressing or decompressing the elastic portion by inflating or deflating the inflatable element. The elastic portion may comprise one or more inflatable elements which expands or contracts depending on the amount of fluid inserted therein. The size of the outlet therefore changes depending on the amount of fluid present inside the inflatable element. The higher the amount of fluid, the smaller the diameter of the outlet. In a different embodiment, jaws can be still formed by slits or cuts in the elastic element, but instead of a collet, the inflatable element, for example located around the jaws, determines the contraction or expansion of the jaws and thus the dimension of the diameter of the outlet.

Preferably, the method of the invention comprises creating a seat for a conveyor belt in an inner surface of the first tubular element; positioning the conveyor belt through the seat in the first tubular element; placing the elongated rod into the conveyor belt; and moving the conveyor belt in a direction from the inlet to the outlet of the first tubular element so that the elongated rod is compressed while exiting the first tubular element. For example, a conveyor belt may run through the diameter adjusting device and force the elongated rod out of the first tubular element. In order to avoid that the junction between the conveyor belt, where a portion of the elongated rod is in contact to, and the inner surface of the first tubular element creates a mark onto the elongated rod when the elongated rod is compressed, a seat is created into the channel of the first tubular element. Preferably, this seat has a size such that, when the conveyor belt is inserted into the first tubular element, the resulting surface surrounding the elongated rod, surface which is formed by a portion of the inner surface of the first tubular element and an upper surface of the conveyor belt in contact to the elongated rod, forms substantially a continuous surface without protrusions or discontinuities. Further, preferably, in cross section along a plane perpendicular to the longitudinal axis the resulting surface formed by the conveyor belt upper surface and by the portion of inner surface of the first tubular element in contact to the rod is substantially circular.

Preferably, the method of the invention comprises providing a conveyor belt transporting the elongated rod up to the inlet of the first tubular element; and forcing the elongated rod into said inlet by a force applied by incoming following portions of the elongated rod still present onto the conveyor belt. The elongated rod may be placed onto a conveyor belt that transports the rod till the inlet of the first tubular element. At the inlet, the elongated rod may enter into the diameter adjusting device just by the pressure of the incoming following parts of the elongated rod still placed onto the moving conveyor belt. At the outlet, another conveyor belt may transport the elongated rod exiting the first tubular element and having the final diameter away from the diameter adjusting device. In this case, the channel of the first tubular element is preferably radially symmetric.

Preferably, the method comprises displaying information relative to the outlet diameter of the first tubular element. A control by the operator of the outlet diameter may be possible if information about the outer diameter are displayed. The outlet dimension can be checked by an operator and changed accordingly.

Advantageously, the method comprises sensing a compression strength needed to compress the elongated rod to the final diameter. More preferably, the method also includes modifying the outlet diameter dimension as a function of the compression strength. A measure of the strength of a force applied to the elongated rod and needed in order to change the preliminary diameter of the elongated rod to its final diameter is also an indication of the firmness of the elongated rod. Variations of this compressor strength from an optimal predetermined interval may therefore indicate that the compressed rod outputted by the diameter adjusting device may not have the proper firmness. These variations in strength may take place due to variations in the characteristics of the material forming the elongated rod, in changes of the material making the elongated rod or in the selection of a different preliminary initial diameter, in case a different aerosol forming article is to be produced. In case there is a variation in the compression strength outside a set desired interval, preferably a feedback signal, a warning signal, an alarm or a combination thereof may be sent to warn about the situation of a possibility of a non-optimal final product. In addition to the warning or alarm signal, the diameter of the outlet of the first tubular element can be changed, so that the final firmness of the elongated rod returns within the desired range. The invention may provide an automated real time diameter adjustment according to compression response to compression of the elongated rod being processed.

The so obtained elongated rod having the final diameter is then preferably further processed so as to form a component of an aerosol-forming article.

Advantageously, the first tubular element is radially symmetric. A "radially symmetric element" means that there is a central axis, the longitudinal axis X, from which the element radiates; identical parts are arranged in a circular fashion around the longitudinal axis X. Therefore, any plane containing the longitudinal axis X divides the element in two identical parts.

Preferably, The method comprises: including the elongated rod having the adjusted diameter in an aerosol forming device. The elongated rod, after the adjustment of its diameter, can be used in an aerosol forming article.

The invention will be further described, by way of example only, with reference to the accompanying drawings in which:

FIG. 3 shows a phase of the method of the invention using the first embodiment of the diameter adjusting device of FIG. 1;

FIG. 4 shows a lateral view in section of a second embodiment of a diameter adjusting device used in the method of the invention;

Figure 6:
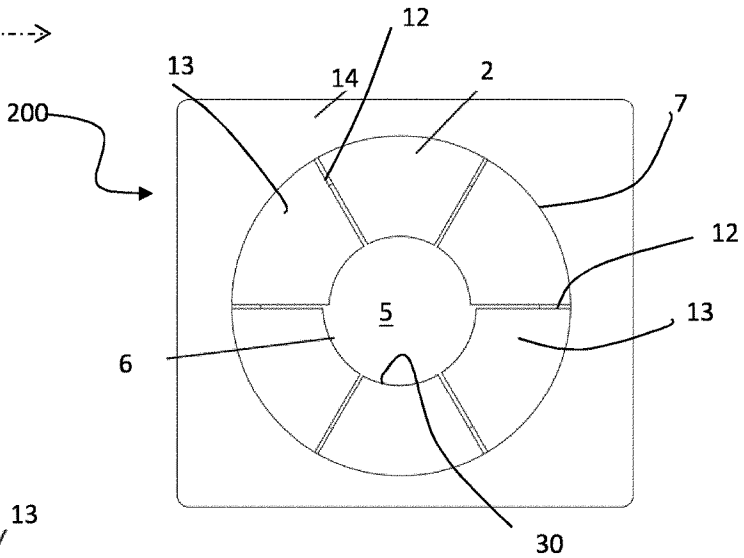
Figure 8:
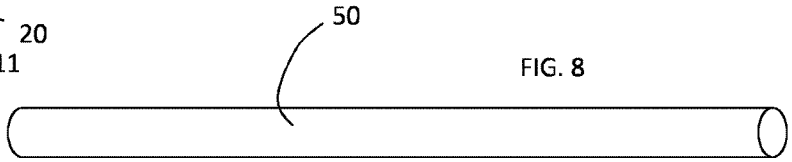

FIG. 4*a* shows an enlarged perspective view of an element of the second embodiment of the diameter adjusting device of FIG. 4;

FIG. 5 shows a lateral view in section of a third embodiment of a diameter adjusting device used in the method of the invention;

FIG. 6 shows a front view of a fourth embodiment of a diameter adjusting device used in the method of the invention with some element removed;

FIG. 7 shows a front view of the fourth embodiment of the diameter adjusting device of FIG. 6 with the elements which were removed in FIG. 6 added; and FIG. 8 schematically shows a perspective view of an elongated rod, subject to the method of the invention.

The method of the invention operates on an elongated rod 50 such as the one schematically depicted in FIG. 8. The elongate rod 50 has a preliminary diameter before the application of the method of the invention and reaches a final diameter afterwards. The final diameter is smaller than the preliminary diameter. The elongated rod may be wrapped in paper 31 (shown only in FIG. 7), called wrapping paper.

The method of the invention modifies the preliminary diameter of the elongated rod 50 into the final diameter by means of a diameter adjusting device.

Figure 1:
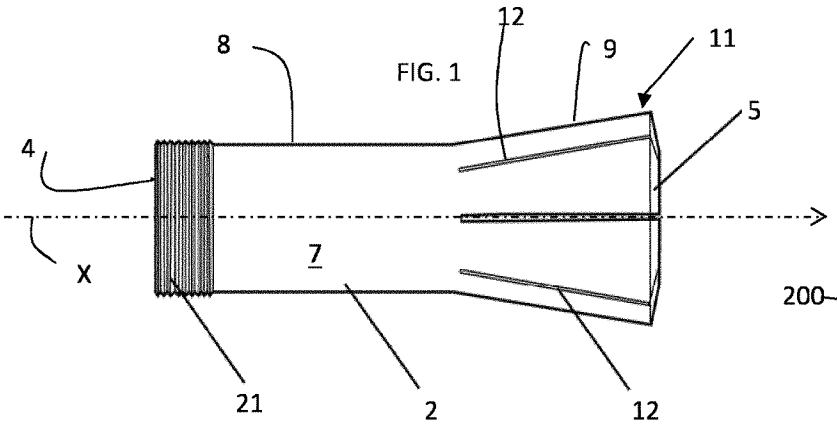
FIG. 1 shows a lateral perspective view of an element of a first embodiment of a diameter adjusting device used in the method of the invention.
Figure 2:
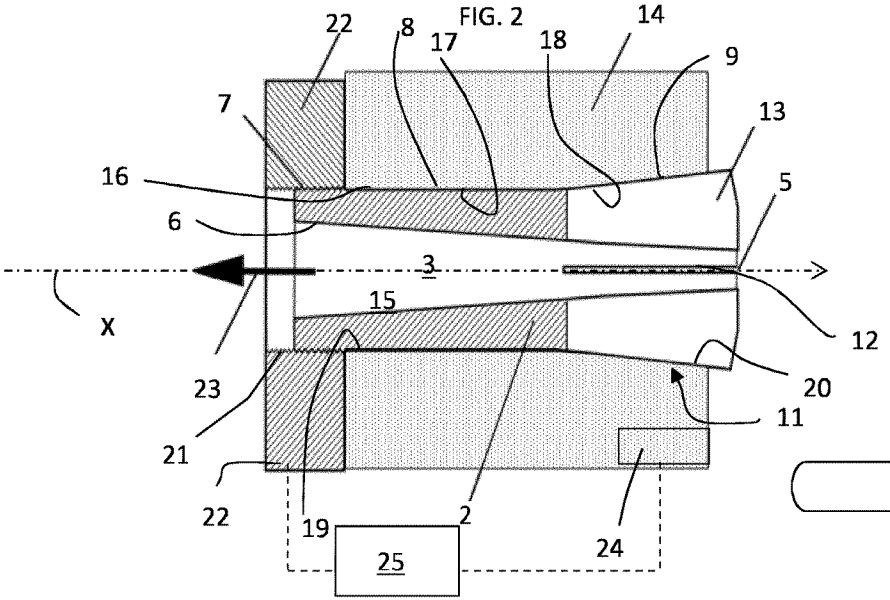
FIG. 2 shows a lateral view in section of the first embodiment of the diameter adjusting device including the element of FIG. 1.

A first embodiment of a diameter adjusting device 1 used in the method according to the invention is represented in FIGS. 1-3.

In all embodiments, element which are substantially identical have been identified with the same reference numeral.

The diameter adjusting device 1 includes a first tubular element 2 defining an inner channel 3 which connects an inlet 4 and an outlet 5 of the first tubular element 2. The first tubular element 2 defines a longitudinal axis X passing through the channel 3 and through the inlet and the outlet. Preferably, a cross section of the channel 3 along a plane perpendicular to the longitudinal axis X defines a shape which is radially symmetric. In the depicted embodiment, the defined shape is a circumference. Preferably, all cross sections of the channel 3 along planes perpendicular to the X axis define each a radially symmetric shape and more preferably the shapes are circumferences. Also the inlet 4 and the outlet 5 of the channel 3 are circular, that is, they are circumferences. Therefore, the inlet 4 and the outlet 5 define an inlet diameter and an outlet diameter, respectively. The outlet diameter is preferably equal to or smaller than the inlet diameter.

The first tubular element 2, visible in detail in FIGS. 1 and 2, further defines an internal surface 6, which is the surface of the channel 3, and an external surface 7. Preferably, the internal surface 6, when the first tubular element 2 is in an uncompressed state, is substantially cylindrical, that is, all cross sections along a plane perpendicular to the longitudinal axis X of the channel 3 define circumferences having all the same diameter. In an uncompressed state (shown in FIG. 1), therefore, the diameter of the inlet 4 is substantially identical to the diameter of the outlet 5.

Further, the external surface 7 comprises a first portion 8 having a first length along the X axis and preferably substantially cylindrical, that is, the first portion 8 includes a cylindrical surface having a constant diameter in cross section along planes perpendicular to the longitudinal axis X for the first length. The external surface also includes a second portion 9 which is tapered for a second length, that is, cross sections of this tapered external surface along planes perpendicular to the X axis and taken at different position along the X axis define shapes having different diameters. The first and second portions 8, 9 are geometrically consecutive one to the other and one extends from the other along the longitudinal axis X. Preferably, the second tapered portion 9 has a cone-like shape, which means that all cross sections of the second portion 9 along plane perpendicular to the X axis define circumferences, which may have different diameters depending on the position along the X axis where the sectioning plane is positioned. The largest diameter defined by the tapered second portion 9 of the external surface 7 in a cross section along a plane perpendicular to the longitudinal axis X is at the outlet 5 of the channel 3 and the diameters of the cross sections of the second tapered portion 9 decrease moving the sectioning plane towards the inlet 4.

The diameter of the outlet 5 can, according to the invention, be adjusted in real time.

The first tubular element 2 further includes an elastic portion 11. Preferably, the elastic portion 11 comprises the second tapered surface 9. In this first embodiment of FIGS. 1-3, the elastic portion 11 includes one or more kerf cuts 12 or slits along its length. The cuts 12 depart from the outlet 5, extend towards the inlet 4, and are preferably substantially parallel to the X axis. The cuts 12 divides the elastic portion 11 in "jaws" 13 and thus also divides the outlet 5 in separated arcs of circumference, one for each jaw 13. Preferably, the cuts 12 are radially symmetric so that the jaws 13 are also radially symmetric.

The kerf cuts 12 allow the elastic portion 11 to contract when pressing on the external surface 9 of the first tubular element 2 at the elastic portion 11, making the jaws cylindrical opening diameter, which is the diameter of outlet 5, becoming smaller than the overall inside diameter of the channel 3, and in particular smaller than the diameter of the inlet 4. Indeed, when compressed, the spacing between the various jaws 13 decreases and also the spacing between the different arcs of circumference forming the outlet 5 also decreases, reducing its diameter. When jaws 13 are compressed, the inner surface 6 of channel 3 includes also a tapered portion, where the jaws 13 are located.

Reciprocally, the jaws cylindrical opening diameter, that is the outlet diameter, expands when releasing such pressure, and—as already mentioned—in the uncompressed state the diameter of the outlet 5 can reach the inlet diameter. In this state, the channel 3 has an overall diameter which is equal along its whole length. In this way, the diameter of the outlet 5 can be varied and regulated, operating on jaws 13.

The diameter adjusting device 1 further includes a second tubular element 14. The second tubular element 14 also defines an inner channel 15 connecting an inlet 19 and an outlet 20, and an inner surface 16. The inner surface 16 of the channel 15 of the second tubular element 14 is preferably funnel shaped and more preferably includes two geometrically consecutive portions, a first portion 17 having a constant diameter for a given length along the longitudinal axis X and a second portion 18 which is tapered. Advantageously, the inner surface 16 of channel 15 is radially symmetric. Preferably, the second portion 18 has a taper which mates in shape the second tapered portion 9 of the first tubular element 2, for example they have the same slope. In this configuration, the outlet 20 of the second tubular element 14 has a larger diameter than the inlet 19 of the second tubular element. The first tubular element 2 is inserted into the second tubular element 14 along the X axis, introducing the first tubular element in the outlet 20 of the second tubular element. When the first tubular element 2 is inserted in the second tubular element 14, channel 3 and channel 15 are substantially coaxial both having as longitudinal axis the X axis. The first tubular element 2 is inserted with its inlet 4 forward. The insertion terminates when the tapered portion 9 of the external surface 7 of the first tubular element 2 abuts onto the tapered portion 18 of the inner surface 16 of the second tubular element 14. A further insertion of the first tubular element 2 into the second tubular element 14 results in the exertion of a force on the elastic portion 11 of the first tubular element 2, compressing the jaws 13, decreasing the diameter of the outlet 5 of the first tubular element 2.

Preferably, the first tubular element 2 includes threads 21 formed at its inlet 4. Preferably, the threads are formed in a portion of the external surface 7 of the first tubular element 2 which protrudes from the second tubular element 14 and therefore is accessible from the outside. The diameter adjusting device 1 further includes regulating means for the regulation of the diameter of the outlet 5. The regulating means include, in the embodiment of FIGS. 1-3, an outer collar 22 that can be screwed on threads 21 creating a force 23, depicted with an arrow in FIG. 2, drawing the first tubular element 2 further into the second tubular element 14.

Accordingly, when the first tubular element 2 is drawn into the second tubular element 14 by means of the screwing of the collar 22 on the threads 21, the second tapered portion 18 of the second tubular element 14 presses on the jaws 13 of the second tapered portion 9 of the first tubular element 2, which in turn decreases the inner diameter of the elastic portion 11 of the channel 3, including the outlet 5. This reduction in diameter is obtained applying a radial force on the jaws 13 of the elastic portion 11. If the elongated rod 50 is present inside the first tubular element 2, this radial force is in turn applied onto the elongated rod 50. Unscrewing the collar 22 from the threads 21 reduces the compression force and in turn increases the diameter of the outlet 5 due to a reduced compression on the jaws 13 of the elastic portion 11.

According to a different embodiment of the invention, not depicted, the regulating means instead of threads 21 and collar 22 include a hydraulic system that can tight or loose the jaws 13 of the elastic portion 11.

According to an even further different embodiment of the invention, also not depicted in the appended drawings, the regulating means include a magnetic system that can tight or loose the jaws 13 of the elastic portion 11.

Preferably, the diameter adjusting device 1 comprises a sensor 24 apt to measure the amount of compression force exerted by the jaws 13 onto the elongated rod 50, when the latter is inserted in the first tubular element 2, and to emit signals function of the measured compression value. Moreover, diameter adjusting device 1 may include a control unit 25 apt to receive the signals emitted from the sensor 24 in order to optionally command the regulating means to change the dimension of the diameter of the outlet 5 depending on the value of the signals sent by sensor 24.

Advantageously, the diameter adjusting device 1 may also comprise a diameter measuring device, not shown in the drawing, located downstream of the outlet 5, adapted to measure the final diameter of the elongated rod exiting the first tubular element 2. The diameter measuring device is preferably connected to the control unit 25 adapted to receive the signals emitted from the diameter measuring device in order to optionally command the regulating means to change the dimension of the diameter of the outlet 5 depending on the value of the signals sent by the diameter measuring device.

The method of the invention will be now described with reference to FIG. 3. The tubular rod 50 having a preliminary diameter and obtained with any method known in the field is inserted inside the diameter adjusting element 1 via the inlet 4. The rod 50 is advanced into the first tubular element 2 in the direction indicated by the arrow 26. Meanwhile, a specific diameter of the outlet 5 has been selected and set by means of the regulating means, in this case collar 22 and threats 21, as a function of the desired final diameter of the elongated rod 50. The diameter of the outlet 5 which has been selected imposes a specific configuration on the jaws 13 which compress the rod 50 while it exits the first tubular element 2. The rod 50 coming out of the first tubular element has thus a final diameter which is function of the diameter of the outlet 5.

In the embodiment where the diameter adjusting device has a radial symmetry, the diameter adjusting device 1 advantageously provides an identical centered pressing force onto the elongated rod 50 all around its outer circumference, due to the fact that the elastic portion 11 is radially symmetric and the element compressing the elastic portion is also radially symmetric, and therefore it produces a cylindrical elongated rod 50 with selected hardness all around its outer circumference. Further, being the inner surface 6 in contact to the rod 50 substantially continuous or with minimal cuts having a very small dimension, no marks are produced on the surface of the rod 50.

Preferably, the final diameter of the elongated rod 50 outputted from the diameter adjusting device 1 may be measured by the diameter measuring device. The diameter of the outlet 5 is thus varied accordingly depending on the measured diameter of the outputted rod. Preferably, a comparison is made between the measured final diameter of the rod and the desired final diameter. Depending on the value of the difference, the outlet diameter may be changed, for example by means of a command of the control unit 25 which elaborates the signals coming from the diameter measuring device. Further, preferably the force necessary to compress the elongated rod 50 to its final diameter is measured by means of sensor 24 and the outlet diameter possibly varied accordingly, depending on the value of the measurement. Signals function of the compression force are for example sent by sensor 24 to control unit 25 which elaborates the signal and possibly changes the diameter of the outlet 5. For example, if the compression force is above a first force threshold, the resulting elongated rod may have a too high firmness, therefore it is preferable that the diameter outlet is increased, operating by a suitable signal the regulating means. In case a weak force, that is a force below a second force threshold, is applied to the elongated rod, than the firmness of the resulting elongated rod may result too low. In this case, therefore, a decrease in the width of the diameter is preferred and a command to the regulating means to decrease the size of the outlet is preferably sent. Alternatively, a higher resistance to compression of the material forming the rod 50 can be balanced by a slightly larger diameter of the outlet 5 so that the overall elongated rod hardness or firmness results unchanged from an optimal range of value. Reciprocally, a lower resistance to compression of the material forming the rod 50 can be balanced by a slightly tighter diameter of the outlet 5 so that the overall elongated rod hardness or firmness remains unchanged from an optimal range of values.

According to a second embodiment depicted in FIGS. 4 and 4*a*, the diameter adjusting device 10 includes a tubular hollow cover 27 to cover cuts 12 of the elastic portion 11, to avoid the cuts to mark the elongated rod 50, and more preferably to avoid marks on the wrapping paper which may wrap the elongated rod 50. The tubular hollow cover 27 may be over molded, glued or stuck to the inner surface 6 of the channel 3, to offer a continuous surface to the elongated rod 50. Preferably, the tubular hollow cover 27 has a shape of a hollow elastic cone. An inner surface coating with PTFE or silicon can be applied to reduce friction between the inner surface 6 and the elongated rod 50.

The functioning of this second embodiment is analog to that of the first embodiment.

In a third embodiment of the diameter adjusting device 100 depicted in FIG. 5, the elastic portion 11 comprises an internal inflatable part 28, which can be inflated to adjust the internal diameter of the elastic portion 11. The inflatable part is located at the elastic portion, including the outlet 5, and can change the size of the inner surface of the channel 3 in cross section. In this way the diameter of the outlet 5 can be adjusted, changing the quantity of fluid inside the inflatable part 28.

The functioning of the third embodiment of the diameter adjusting device 100, besides the inflation or deflation of the elastic portion, is analog to the functioning of the diameter adjusting device 1 according to the first embodiment.

According to a fourth embodiment of the invention, not depicted in the drawings, the elongated rod 50 having the preliminary diameter is brought to the diameter adjusting device 1, 10, 100 at its inlet 4, by means of a first conveyor belt. In the fourth embodiment of the invention, the first conveyor belt ends at the inlet, that is, the conveyor belt, preferably a high speed conveyor belt, does not run into the first tubular element 2, but it stops before entering in the inlet 4. The elongated rod 50 is pushed into the first tubular element 2 by the frictions forces of the incoming other parts of the rod which are still on the outside first conveyor belt. At the outlet 5 of the first tubular element 2, after compression, a second conveyor belt is preferably present, to transport the compressed elongated rod 50 having its final diameter away from the diameter adjusting device 1, 10, 100. Preferably, also the second conveyor belt is a high speed conveyor belt. The tubular rod 50 having the final diameter is pushed onto the second conveyor belt at the outlet 5 of the first tubular element 2, and the second conveyor belt drags the rod 50 out of the first tubular element 2, using the friction forces of the elongated rod portions which have already exited the first tubular element, as well as the paper resistance to tearing in case of a wrapped elongated rod 50.

In an alternative fifth embodiment, depicted in FIGS. 6 and 7, the diameter adjusting device 200 includes a single conveyor belt 29, preferably a high speed conveyor belt, which runs into and through the first tubular element 2. Preferably, the conveyor belt 29 is U shaped at least for its portion located inside the first tubular element 2, so as to abut onto the inner surface 6 of the channel 3, preferably without forming gaps.

In this embodiment, the channel 3 is not radially symmetric as in the previous embodiments. A portion of the inner surface 6 includes a seat 30 apt to house the conveyor belt 29. Therefore, a cross section of the channel 3 on a plane perpendicular to the X axis defines a first arc of circumference in correspondence of seat 30 having a first radius and a second arc of circumference having a second radius, where the seat is not present. The first radius is longer than the second radius. The size of the conveyor belt 29, in cross section, that is, the conveyor belt thickness, is such that when the conveyor belt is inserted in seat 30, the thickness of the conveyor belt matches the difference between the first and second radius, so that, once the conveyor belt 29 is inside the seat 30, the global inner surface formed by inner surface 6 and top surface 33 of the conveyor belt 29 into which is in contact with the elongated rod 50 is a cylinder.

The seat 30 and the difference between the first and second radius defined in the seat 30 region and in the region seat-free of channel 3 are visible in FIG. 6.

In the second front view of FIG. 7, the conveyor belt 29 inside seat 30 is represented. In this view, also the elongated rod 50 is shown, wrapped in paper 31, inserted in the first tubular element 2 on the conveyor belt 29.

In all mentioned embodiments of the diameter adjusting device 1, 10, 100, 200, the device, for example the regulating means, may be adapted to display information indicating the outlet diameter of the first tubular element 2.

Further, strength sensor 24 giving information about the compression strength needed to change the diameter of the elongated rod 50 into the final diameter and a diameter measuring device to measure the final diameter of the elongated rod exiting the outlet of the first tubular element may be present in all embodiments of the diameter adjusting device 1, 10, 100, 200. Control unit 25 apt to emit signals as feedback to the signals received by sensor 24 and diameter adjusting device may be present as well.

The so formed elongated rod 50 having its final diameter may be further processed in order to obtain an aerosol-forming article (not depicted in the appended drawings).

The invention claimed is:

1. A method for manufacturing an aerosol forming device, including:

providing an elongated rod having a preliminary diameter;

selecting a desired final diameter of the elongated rod;

providing a diameter adjusting device including a first tubular element having an inlet and an outlet and a channel connecting the inlet and the outlet, wherein said first tubular element includes an elastic portion, the elastic portion including the outlet;

adjusting the diameter of the outlet as a function of the desired final diameter of the elongated rod, wherein the diameter of the inlet is bigger than the diameter of the outlet when adjusted, wherein adjusting the diameter of the outlet includes compressing or decompressing the elastic portion;

inserting the elongated rod in the diameter adjusting device from the inlet and outputting it from the outlet so that said elongated rod is compressed to the desired final diameter when outputted from the outlet of the first tubular element;

providing the elastic portion with slits cutting the elastic portion substantially along a longitudinal axis of the first tubular element; and compressing or decompressing the elastic portion by reducing or enlarging the slits spacing.

2. The method according to claim 1, including:

measuring the diameter of the elongated rod at the outlet of the first tubular element; and adjusting the diameter of the outlet of the first tubular element on the basis of the diameter measurement.

3. The method according to claim 1, wherein the elastic portion includes an outer surface which is funnel-shaped or an inner surface which is funnel-shaped, or both an inner and an outer surfaces which are funnel-shaped, when the adjusting the diameter of the outlet takes place.

4. The method according to claim 1, comprising:

covering said slits by inserting a tubular cover onto the elastic portion to cover an inner surface of the elastic portion where the slits are present.

5. The method according to claim 1, comprising:

providing the diameter adjusting device with a second tubular element;

partially inserting the first tubular element into the second tubular element; and adjusting the diameter of the outlet of the first tubular element by inserting the first tubular element for a longer or shorter portion into the second tubular element.

6. The method according to claim 5, comprising:

providing the first tubular element with a tapered external surface portion including the outlet, the tapered external surface portion having the widest dimension of its external surface at the outlet of the first tubular element;

providing the second tubular element with a tapered internal surface portion, the tapered internal surface having a mating shape with the external surface of the tapered external surface portion of the first tubular element; and inserting the first tubular element inside the second tubular element so that the tapered external surface portion of the first tubular element is compressed due to the tapered internal surface portion of the second tubular element.

7. The method according to claim 5, wherein the inserting the first tubular element into the second tubular element comprises:

providing the first tubular element with a threated portion at the inlet;

providing a collar coupled to the threated portion; and screwing or unscrewing the collar to push said first tubular element inward or outward, respectively, the second tubular element.

8. The method according to claim 5, wherein the inserting the first tubular element into the second tubular element comprises:

providing a magnetic actuator or a hydraulic system to insert the first tubular element for a longer or shorter portion into the second tubular element.

9. The method according to claim 1, comprising:

providing the elastic portion with an inflatable element; and compressing or decompressing the elastic portion by inflating or deflating the inflatable element.

10. The method according to claim 1, comprising:

creating a seat for a conveyor belt in an inner surface of the first tubular element;

positioning the conveyor belt through the seat in the first tubular element;

placing the elongated rod into the conveyor belt; and moving the conveyor belt in a direction from the inlet to the outlet of the first tubular element so that the elongated rod is compressed while exiting the first tubular element.

11. The method according to claim 1, comprising:

providing a conveyor belt transporting the elongated rod up to the inlet of the first tubular element; and forcing the elongated rod into said inlet by a force applied by incoming following portions of the elongated rod still present onto the conveyor belt.

12. The method according to claim 1, comprising:

displaying information relative to the outlet diameter of the first tubular element.

13. The method according to claim 1, comprising:

sensing a compression strength needed to compress the elongated rod to the final diameter.

14. The method according to claim 13, comprising:

modifying the final diameter of said outlet of the first tubular element as a function of said compression strength.

15. The method according to claim 1, wherein the first tubular element is radially symmetric.

16. The method according to claim 1, comprising:

including the elongated rod having the adjusted diameter in an aerosol forming device.

* * * * *